United States Patent [19]

Niemeyer et al.

[11] 4,319,527

[45] Mar. 16, 1982

[54] BLASTING CHARGE FOR A BLAST ACTUATED HIGH-VOLTAGE POWER SWITCH

[75] Inventors: Lutz Niemeyer, Baden; Klaus Ragaller, Neuenhof, both of Switzerland

[73] Assignee: BBC Brown, Boveri & Company, Ltd., Baden, Switzerland

[21] Appl. No.: 111,176

[22] Filed: Jan. 10, 1980

[30] Foreign Application Priority Data

Jan. 11, 1979 [CH] Switzerland ..... 244/79

[51] Int. Cl.[3] ..... F42B 3/00

[52] U.S. Cl. ..... 102/314; 200/61.08

[58] Field of Search ..... 102/24 R, 28 R, 32, 102/90, 314; 200/61.08

[56] References Cited

U.S. PATENT DOCUMENTS

| | | | |
|---|---|---|---|
| 3,132,585 | 5/1964 | Higashishima et al. | 102/28 R |
| 3,566,791 | 3/1971 | Lohkamp | 102/32 |
| 3,667,388 | 6/1972 | Heinemann | 102/28 R |
| 3,848,100 | 12/1974 | Kozorezov et al. | 200/61.08 |
| 4,012,613 | 3/1977 | Watson | 200/61.08 |
| 4,150,266 | 4/1979 | Patrichi | 200/61.08 |

FOREIGN PATENT DOCUMENTS

| | | | |
|---|---|---|---|
| 1159965 | 7/1969 | United Kingdom | 200/61.08 |

*Primary Examiner*—Peter A. Nelson

*Attorney, Agent, or Firm*—Burns, Doane, Swecker & Mathis

[57] ABSTRACT

An improved blasting charge for a blast-actuated high voltage power switch is provided which contains at least one electrically combustible detonator and one blasting powder, the blasting powder containing a compound which forms electro-negative gases upon thermal decomposition. Halogen compounds are preferred compounds for use in the blasting powder.

8 Claims, No Drawings

BLASTING CHARGE FOR A BLAST ACTUATED HIGH-VOLTAGE POWER SWITCH

BACKGROUND OF THE INVENTION

The present invention concerns a blasting charge for a high-voltage power switch actuated by blasting which contains at least one electrically combustible detonator and blasting powder.

In order to protect high-voltage power lines against dynamic and thermal stresses which occur during steep current rises, especially in the case of a short-circuit, it is necessary to disconnect the line before the short-circuit reaches the first peak value (if the line carries alternating current), or its final value (if the line carries direct current). The time limits for such a disconnection are dependant upon the frequency of the alternating current, or the inductance, capacitance and resistance of the power line, and are measured in milliseconds. Such quick disconnections cannot be attained in practice by means of the mechanically or magnetically triggered switches used with medium and high voltages. Accordingly, switches which are actuated by blasting were developed for such a purpose.

One known type of high-voltage switch which is actuated by blasting is equipped with a tubular conductor bridge which is placed between two terminals of the high-voltage conductor. Within the hollow space of the conductor bridge there is arranged, approximately midway between the two terminals, a detonator connected to an electric ignition device. In order to prevent any scattering of the parts of the conductor bridge during the blasting, the bridge is slotted along its longitudinal axis, and the conductor webs formed by the slots are provided at the center with a groove or a soldered seam, with the result that the webs are bent back around the associated terminal in the shape of a rosette when the conductor bridge is blasted apart.

The energy stored within the inductance of the power line will cause a steep increase in voltage across the terminals when the conductor bridge is blasted. In order to prevent the formation of an arc across the blasted ends of the conductor bridge by this increase in voltage, there is placed in parallel with the conductor bridge a fusible wire which is imbedded in quenching sand, and which is dimensioned in such a manner that the short-circuit current will completely commutate within it. The current will then melt the fusible wire and produce an arc which is cooled intensively by the surrounding quenching sand, thus building up a high voltage and interrupting the current.

However, the dielectric strength i.e. the strike through voltage across the blasted ends of the conductor bridge of the conductor bridge across the blasted ends is impaired due to the presence of clouds of smoke which are generated by the explosion of the detonator and which lowers the breakdown voltage of the gas, filling the switch in an uncontrollable manner due to the high temperature of the smoke.

It is therefore an object of the present invention to provide a blasting charge wherein any clouds of smoke which are generated by the blast will only slightly lower the dielectric strength of the gas filling the switch. Such a feature is accomplished by the present invention by means of a blasting charge which includes a blasting powder which is provided with an admixture which is thermically decomposable at the explosion temperature and which forms electro-negative gases.

This novel bursting charge makes possible the actuation of a high-voltage power switch by blasting at a relatively minor increase in dielectric strength, and furthermore, makes the application of a higher voltage across the blasted conductor ends feasible, and thus an increase in the rated voltage of the facility.

In a preferred embodiment of the novel blasting charge, there is thus provided a blasting charge which consists at least in part of covalent fluoride compounds and more preferably of fluorocarbon compounds which will form fluoride-containing gases during the thermal decomposition of the charge.

In a further preferred embodiment, the blasting charge consists at least in part of a fluorocarbon compound which is in the form of a paste and which is mixed with a binding agent to permit the manufacture of a blasting charge body which does not require an outer cover.

DETAILED DESCRIPTION OF THE INVENTION

The blasting charges which are conventionally used for the blasting of a conductor bridge installed in high-voltage switches of the type described above contain, for example, 0.3 gram of lead azide, acting as a detonator, and 0.7 gram of tetranitramethylaniline ("Tetril"), which acts as the blasting powder. When this material explodes, carbon, carbon monoxide and dioxide, nitrous gases, water and other decomposition products are liberated. The detrimental influence of these liberated components on the dielectric characteristics of a discharge gap have been discussed above.

The selection of an admixture which is capable of compensating for these disadvantages is based on the fact that fluorine is the most powerful electro-negative element and is thus able to bind and most effectively neutralize any free electrons. An admixture of 10 to 30 percent of sulphurhexafluoride ($SF_6$) or carbontetrafluoride ($CF_4$) in the air will increase the breakdown voltage of a discharge gap by a factor of 1.5 to 2. Fluoride compounds are not very suitable for this specific purpose because they do not form any electro-negative groups at the time of decomposition. However, practically all covalent fluoro-compounds are suitable, provided they do not contain any, or only a small amount of hydrogen which could form hydrogen fluoride at the time of decomposition.

All fluorocarbon compounds have been found to be suitable. Preferred compounds include perfluorocarbon compounds as expressed by the general formulae $C_nF_{2n+2}$, $C_nF_{2n}$ or $C_nF_{n+1}$ which will form electro-negative fluoro radicals at the time of decomposition. Obviously, it is also possible to utilize fluoropolymers such as polytetrafluoroethylene, tetrafluoroethylene-perfluoropropylene copolymers, perfluoroalkoxy copolymers, ethylenetetrafluoroethylene copolymers, polyvinylidenefluoride or polyvinylfluoride.

Chlorides resemble the fluoro compounds in strength as an electro-negative element. It is thus possible to also utilize corresponding chloride or fluoro-chloride compounds for the purpose of the present invention. Such compounds include polychlorotrifluoroethylene or ethylenechlorotrifluoroethylene copolymers.

Generally, the compounds which decompose to form electro-negative gases (exemplified by the above-named compounds) may be employed in amounts ranging from about 2 to about 30 percent by weight, based on the weight of the blasting powder in the blasting charge. The residual portion of blasting powder may consist of blasting powder which is conventionally employed in such blasting charges. The blasting powder is combined with a conventional electrically combustible detonator (e.g. lead azide) in conventional proportions to form the blasting charge.

Although the admixtures listed above are solids under normal conditions, it is obviously also possible to use liquid or gaseous admixtures. However, in this case, it will become necessary to provide the blasting charge with an outer cover which is liquid or gas-proof. Difluorodichloromethane ("Freon") or monofluorotrichloromethane ("Frigen") are, for example, admixtures which are gaseous under normal conditions but which can be easily liquefied.

Of particular interest, however, are fluoro polymers which are soluble in solvents or which are capable of swelling. These substances can be kneaded as a paste or the semi-liquid state into the blasting powder and formed into a body by pressing which body can then be utilized without any outer cover. Such an explosive body has the advantage that the pressure generated at the time of explosion need not be partially expended to blast open the cover but can be fully utilized for the blasting of the conductor bridge, thus allowing a reduction in the total amount of the blasting powder and thus of the gases generated in the course of the explosion.

The blasting powder used for the novel blasting charge of the present invention should preferably have an oxygen balance that is smaller than—100/100 gram. Such an arrangement will prevent the presence of free oxygen during the thermal decomposition which could result in the capture of electro-negative radicals, thus rendering them ineffective for their intended purpose. Blasting powders which consist of or contain nitro-compounds are for this reason more suitable than ester-based explosives.

The novel admixture will only slightly influence the pressure effect and the shattering power of the explosive because the admixed material is decomposed at the time of the explosion and forms hot gases. However, the admixture may act as a desensitizer with respect to the speed of the detonation and it will therefore be expedient to utilize a blasting powder having a high detonation speed, for example the above-mentioned "Tetril" or preferably cyclotrimethylene-trinitramine ("Hexogene") in admixture with the electronegative gas-producing compounds previously described.

Care should be taken when selecting the blasting powder that the explosion temperature which is generated is not excessively high since the thermal decomposition products of the admixture are partially controlled and determined by this temperature.

The invention is additionally illustrated in connection with the following Examples which are to be considered as illustrative of the present invention. It should be understood, however, that the invention is not limited to the specific details of the Examples.

EXAMPLE 1

An exemplary blasting charge of the present invention is prepared by intermixing "Hexogene" thoroughly with 20 percent by weight of very finely ground polytetrafluoroethylene ("Teflon") and kneading into this mixture 2 percent by weight of a fluoro elastomer which is commercially available under the tradename "Viton" (a linear copolymer of vinylidenefluoride and hexafluoropropylene). A cylindrical blasting charge, suitable for insertion into a conductor bridge, is then formed from this kneaded mass, and the "Viton" is vulcanized in known manner to harden the blasting charge thus formed.

EXAMPLE 2

Another exemplary blasting charge of the present invention is prepared by kneading "Hexogene" and 15 percent by weight of "Viton" together, forming a blasting charge and vulcanizing the "Viton" by the use of polyamides. Since "Viton" contains a high proportion of fluoro compounds, no noticeable difference was found in the effect of the two blasting charges of the Examples with respect to the dielectric strength of the high-voltage power switch.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. In a blast-actuated high voltage power switch comprising a blasting charge, the improvement wherein said blasting charge comprises a blasting powder which contains at least one compound which thermally decomposes during the explosion of the charge to form electro-negative radicals.

2. The high voltage power switch of claim 1 further including an electrically combustible detonator.

3. The high voltage power switch of claim 1 wherein said at least one compound is a halogenated compound.

4. The high voltage power switch of claim 3 wherein said at least one compound is a fluoro-carbon compound.

5. The high voltage power switch of claim 1 wherein said at least one compound is present in an amount ranging from about 2 to about 30 percent by weight, based on the weight of the blasting powder.

6. The high voltage power switch of claim 4 wherein the at least one compound is selected from compounds having the formulae $C_nF_{2n+2}$, $C_nF_{2n}$ and $C_nF_{n+1}$ and mixtures thereof.

7. The high voltage power switch of claim 3 wherein the at least one compound is selected from the group consisting of polytetrafluoroethylene, tetrafluoroethylene-perfluoropropylene copolymers, perfluoroalkoxy copolymers, ethylenetetrafluoroethylene copolymers, polyvinylidenefluoride, polyvinylfluoride, polychlorotrifluorethylene, ethylenechlorotrifluoroethylene copolymers, vinylidenefluoride-hexafluoropropylene copolymers and mixtures thereof.

8. The high voltage power switch of claim 1 wherein the blasting powder is in the form of a paste or semi-liquid.

* * * * *